United States Patent [19]

Arai

[11] Patent Number: 4,915,074

[45] Date of Patent: Apr. 10, 1990

[54] THROTTLE VALVE CONTROL SYSTEM OF ENGINE

[75] Inventor: Katsumi Arai, Ibaraki, Japan

[73] Assignee: Kyosan Denki Kabushiki Kaisha, Tokyo, Japan

[21] Appl. No.: 319,151

[22] Filed: Mar. 3, 1989

[30] Foreign Application Priority Data

Mar. 11, 1988 [JP] Japan ..... 63-56018

[51] Int. Cl.[4] ..... F02D 11/10

[52] U.S. Cl. ..... 123/399; 123/361; 251/65; 251/129.11

[58] Field of Search ..... 123/399, 361; 251/65, 251/129.01, 129.11

[56] References Cited

U.S. PATENT DOCUMENTS 4,601,271 7/1986 Ejiri et al. ..... 123/399 X
4,697,117 9/1987 Kumada ..... 310/323
4,829,209 5/1989 Kawasaki et al. ..... 310/323

FOREIGN PATENT DOCUMENTS 101584 5/1988 Japan ..... 251/129.11

*Primary Examiner*—Tony M. Argenbright
*Attorney, Agent, or Firm*—Flynn, Thiel, Boutell & Tanis

[57] ABSTRACT

A throttle valve control system of engine having an ultrasonic motor for driving a throttle valve fixed to a rotary shaft and positioned in a throttle body forming a suction passage. The throttle valve control system comprises a stator mounted on one side of the throttle body and provided with an elastic member having a plurality of piezoelectric elements and a travelling wave generator surface respectively disposed on the elastic member, and a rotor positioned at the outside of the stator and fixed to an extension of the rotary shaft whereby said rotor being rotatable by receiving the travelling wave generated by the travelling wave generator surface.

2 Claims, 4 Drawing Sheets

THROTTLE VALVE CONTROL SYSTEM OF ENGINE

BACKGROUND OF THE INVENTION

1. Field of the Invention

The present invention relates to a throttle valve control system for regulating a valve opening ratio of the throttle valve employed in an engine of automobile and the like, more particularly to the throttle valve control device for controlling the throttle valve electrically and remotely in response to a depression ratio of an accelerator pedal to be depressed.

2. Description of the Prior Art

An automobile and the like generally control an engine output by regulating an air-fuel ratio to be introduced into a suction passage of the engine in the manner that the throttle valve positioned in the suction passage of the engine is open or closed to thereby vary the area of the suction passage. The throttle valve is operated to be open or closed with interlocking with the depression ratio of the acceleration pedal.

A prior art throttle valve control system is generally structured that acceleration of the accelerator pedal is delivered to the throttle valve via a mechanical means such as link or wire.

However, there are proposed various throttle valve control system having such an arrangement that the throttle valve is controlled electrically and remotely in response to the depression ratio of the accelerator pedal.

A typical prior art throttle valve control system is disclosed in Japanese Patent Laid-Open Publication No. 58-13135 and will be described herewith with reference to FIG. 4.

A throttle valve 31 is driven by a DC motor 32 to thereby be open or closed. More in detail, a rotation of the DC motor 32 is controlled by a motor driver 37 in the manner that an output signal from the valve opening ratio detector 33 for detecting the valve opening ratio of the throttle valve 31 and an output signal from a depression rateio detector 35 for detecting the depression ratio of the accelerator pedal are supplied to a comparator 36 where both the signals are compared with each other on the basis of a predetermined accelerator pedal operation/throttle valve operation characteristic which is stored in the comparator 36 to decide an appropriate valve opening ratio of the throttle valve, and an output signal from the comparator 36 is supplied to a motor drive 37 which amplifies the output signal from the comparator 36 and supplies it to the DC motor 32 for controlling rotation of the DC motor 32. The throttle valve 31 is urged by a return spring 38 in the direction to be closed which is provided for preventing the throttle valve 31 from flapping due to negative pressure caused by the suction air for thereby effecting a stable control of the throttle valve.

The DC motor 32 requires a torque greater than the urging force of the return spring for stably controlling the throttle valve 31 as well as closing the throttle valve. However, since the DC motor 32 runs generally in high speed with small torque, a reduction mechanism such as reduction gear and the like is required to be intervened between the DC motor 32 and a rotary shaft 39 of the throttle valve 31.

An ultrasonic motor having piezoelectric element is known and disclosed in Japanese Patent Laid-Open Publication No. 53-14682. The ultrasonic motor is small in size, light in weight and has a characteristic that it runs at high speed with large torque and a superior response characteristic.

However, there are following problems in the prior art electric throttle valve control system.

First, throttle valve conrol system is complex and large in size since the throttle valve 31 and the DC motor are connected via a reduction mechanism 40.

Secondly, the DC motor 32 is slow in starting of rpm thereof and inferior in the response characteristic.

Thirdly, when the current is stopped to be supplied to the DC motor 32 which is deenergized due to an urgent trouble the throttle valve shall be closed in failsafe point of view. However, there is a problem that the throttle valve is fixedly positioned while it is open due to a load applied thereto by the DC motor 32 and a reduction mechanism when the throttle valve 31 msut be returned to a close state by the return spring 38.

SUMMARY OF THE INVENTION

In view of the problems of the prior art, it is an object of the present invention to provide a throttle valve control system of small size having a simple structure with superior response characteristic.

It is another object of the present invention to provide a throttle valve control system having a function to close the throttle valve when the DC motor is deenergized when the current is not supplied to the DC motor due to the trouble.

The above and other objects, features and advantages of the present invention will become more apparent from the following description taken in conjunction with the accompanying drawing.

DESCRIPTION OF THE PREFERRED EMBODIMENT

Figure 1:
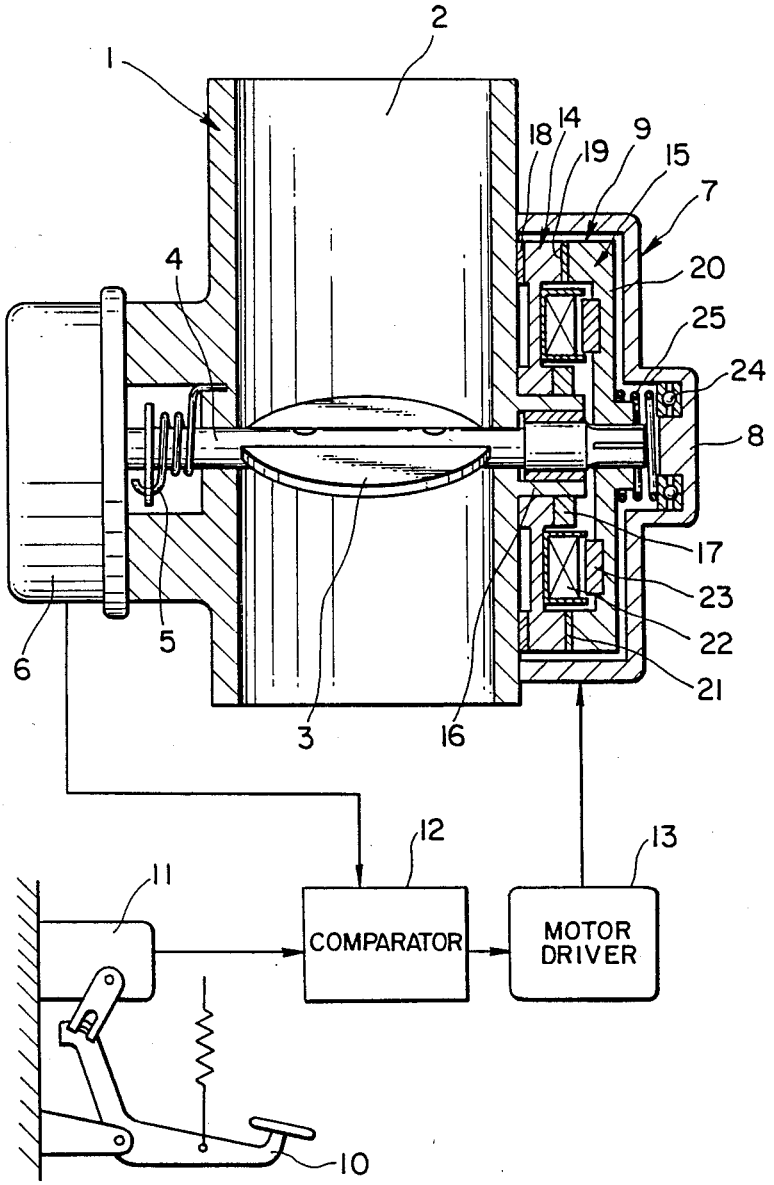
FIG. 1 is a schematic view partly in cross section showing an arrangement of a throttle valve control system according to a preferred embodiment of the present invention.
Figure 2:
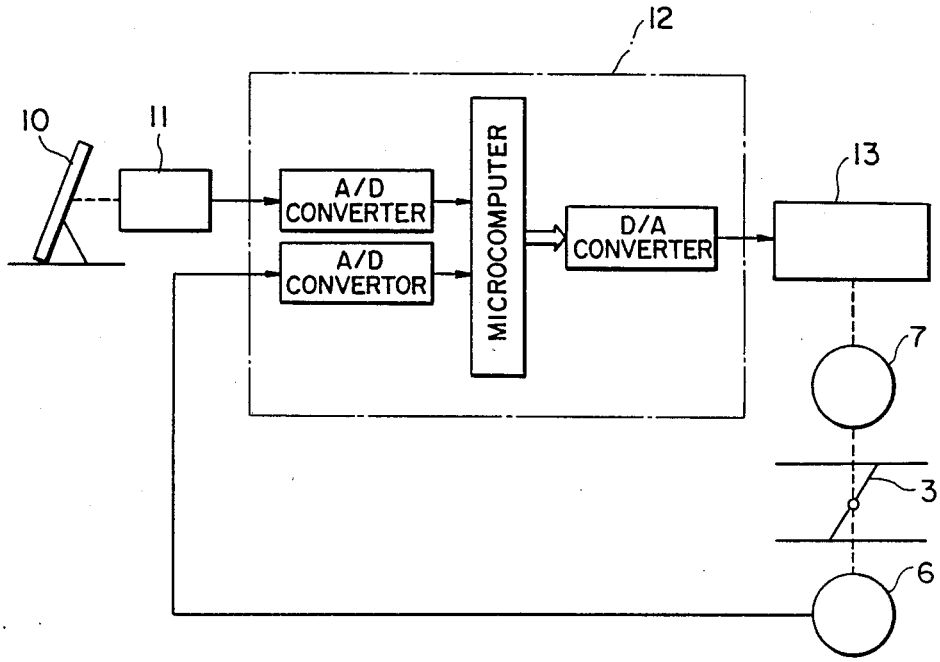
FIG. 2 is a block diagram of the control system in the arrangement of FIG. 1.

A throttle valve control system of the engine according to a preferred embodiment of the present invention will be described with reference to FIGS. 1 to 3.

A throttle valve 3 is positioned in a air passage 2 of a throttle body 1 and rotatably fixed to a rotary shaft 4. The rotary shaft 4 is rotatably fixed to the throttle body 1 at both ends threof. The throttle body 1 has at one side viewed in FIG. 1 a return spring 5 fixed to the rotary shaft 4 for urging the throttle valve 3 in the direction to be closed and a valve opening ratio detector 6 connected to an extension of one end of the rotary shaft 4 for detecting a ratio of opening of the throttle valve 3 and providing a valve opening ratio signal. As the valve opeing ratio signal detector, a potentiometer, tachogenerator or an encoder is arbitrarily adopted. The throttle body 1 has at the other side, opposite to the side where the valve opening ratio detector 6 is positioned, a valve driver unit 7 which has a casing 8 and an ultrasonic motor 9 disposed in the casing 8. The ultrasonic motor 9 has a rotary shaft extended from the other end of the rotary shaft 4. The ultrasonic motor 9 is electrically interlocked with the depression ratio of the accelerator pedal 10 for driving the throttle valve 3.

An operation of the the throttle valve control device will be described more in detail with reference to FIG. 2.

There are provided a depression ratio detector 11 for detecting the depression ratio of the acceleration pedal 10 for providing a depression ratio signal, a comparator 12 for receiving the depression ratio signal from the depression ratio detector 11 and a valve opening ratio signal from the valve opening ratio detector 6 for comparing the depression ratio signal received from the depression ratio detector 11 with the valve opening ratio signal on the basis of the acceleration pedel operation/throttle valve operation characteristic for providing a control signal, and a motor driver 13 for receiving and amplifies the control signal from the comparator and providing the amplified control signal to the ultrasonic motor 9. As a result of comparison in the comparator 12, the comparator 12 provides the control signal to compensate the difference between the value of the the valve opening ratio signal and the value of the depression ratio signal to supply the control signal to the ultrasonic motor 9 via the motor driver 13. The ultrasonic motor 9, on the reception of the control signal from the motor driver 13, drives the throttle valve 3 at the appropriated valve operating ratio.

The ultrasonic motor 9 will be described more in detail.

The ultrasonic motor 9 comprises an annular stator 14 having an elastic member positioned at the side of the throttle body and a disk rotar 15 surface of which is opposite to that of the stator 14. The annular stator 14 is fixed to a bracket 16 projected from the throttle body 1 by a screw 17. The rotor 15 is rotatably fixed to an extension of the rotary shaft 4 and slidable on the extension in an axial direction of the rotary shaft 4. The stator 14 has a plurality of piezoelectric elements 18 which are subjected to polarization and fixed to the elastic member and a travelling wave generator surface 19 for generating a travelling wave when a high frequency voltage is applied tothe piezoelectric elements 18 due to flexion vibration. The stator 15 has a disk rotary ring 20 and an annular sliding member 21 fixed to the disk rotary ring 20 surface of which is opposite to that of the travelling wave generator surface.

An electromagnet 22 is provided on the stator 14 at the side faced to the rotor 15 while a magnetic member 23 is provided annularly on the rotor 15 oppositely to the electromagnet 22. At the time when the eletromagnet 22 is energized by an ignition switch (not shown) which is turned on to attract the rotor 15, the stator 14 is brought into press contact with the rotor 15 for receiving and travelling wave generated on the travelling wave generator surface and starting to rotate. Inasmuch as a mechanism of the ultrasonic motor 9 is known, a detailed explanation thereof will be omitted.

A pressure spring 25 is positioned between a bearing 24 provided an inner surface of the casing 8 and the rotor 15 for pressing the rotor 15 toward the stator 14 and keeping the rotor 15 and the stator 14 normally to contact with each other but not in press contact with each other.

If the electromagnet 22 is deenergized, the stator 14 is released from the state to be brought into press contact with the rotor 15 (although the stator 14 contacts the rotor 15) so that the throttle valve 3 is returned by a spring force of the returning spring 5 which is released from the load to some extent. At this state where the stator 14 is not brought into press contact with the rotor 15, the ultrasonic motor 9 can not rotate.

With the arrangement as set forth above, the throttle valve control device will be operated as follows.

At the time when the ignition switch is turned off, the rotor 15 contacts the stator 14 by the pressure spring 25 but not brings into press contact with the stator 14 so that the rotor 15 does not rotate even if the travelling wave is generated on the travelling wave generator surface 19 of the stator 14.

At the time when the ignition switch is turned on, the current is supplied to the electromagnet 22 of the stator 14 and the electromagnet 22 is energized to attract the magnetic member 23 fixed to the rotor 15 so that the stator 14 and the rotor 15 are brought into press contact with each other. As a result, the travelling wave generated by the travelling wave generator surface 19 is received by the sliding surface 21 for thereby permitting the rotor 15 to rotate.

At this state, when the accelerator pedal is depressed the depression ratio detector 11 detects depression ratio and provides the depression ratio signal which is supplied to the comparator 12. Inasmuch as the valve opening ratio signal provided by the valve opening ratio detector 6 is supplied to the comparator 12, the comparator 12 compares the depression ratio signal with the valve opening ratio signal and provides a control signal to compensate the difference between both signals on the basis of acceleration pedal operation/throttle valve operation characteristic. The control signal is supplied to the motor driver 13. The motor driver 13 amplifies the controls signal and supplies the amplified control signal to the ultrasonic motor 9. Upon receipt of the control signal the ultrasonic motor is driven to regulate the throttle angle of the throttle valve 3. However, if the control signal is not provided by the comparator 12, then the ultrasonic motor is not driven for thereby keeping the throttle valve open at the same throttle angle.

Figure 3:
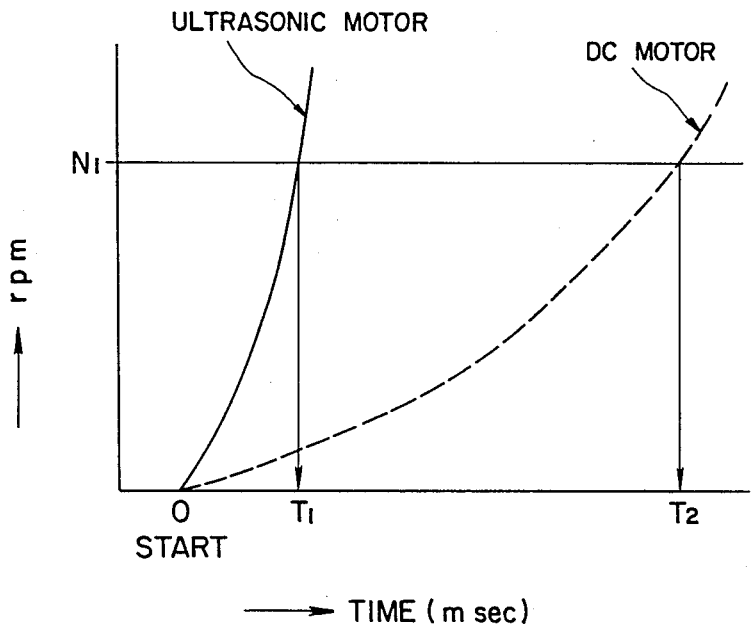
FIG. 3 is a graph showing build up time characteristic of DC motor of the prior art and that of an ultrasonic motor of the present invention.
Figure 4:
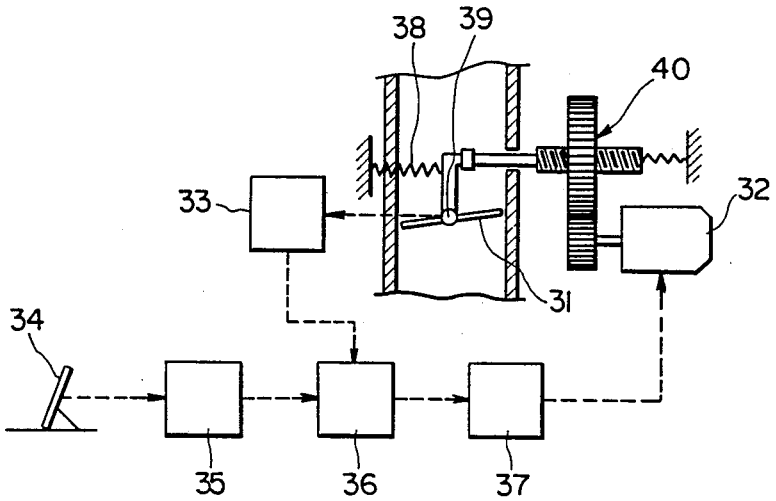
FIG. 4 (PRIOR ART)
FIG. 4 is a schematic view of an arrangement of a prior art throttle valve control system.

FIG. 3 is a graph showing build up time characteristic of DC motor and that of the ultrasonic motor, namely the time from the starting of the motor to reaching a rated speed of the motor. The build up time characteristic of the DC motor is long while that of the ultrasonic motor is very short with high response.

Furthermore, since the DC motor runs with high speed and small torque, it is necessary to intervene the reduction mechanism between the DC motor and the throttle valve, while the ultrasonic motor runs with low speed and large torque, the reduction mechanism is unnecessitated to thereby increase the response characteristic.

Still furthermore, the stator 14 and the rotor 15 of the ultrasonic motor 9 are pressedly brought into contact with each other to generate a frictional force which keeps the throttle valve in a stop position with high accuracy for thereby preventing the throttle valve 3 from flapping due to suction pressure and controlling unstably due to vibration of the machine.

Provided that the current is stopped to be supplied to the electromagnet 22 of the ultrasonic motor 9 due to the urgent trouble of the throttle valve control system, the current is stopped to be supplied to the electromagnet 22 to be deenergized to release the pressure contact between the stator 14 and the rotor 15 (although they contact by the pressure spring 25) so that the throttle valve 3 is closed by the spring force of the return spring 5 which is released from the load to some extent. As a result, the failsafe function is demonstrated. At the state where the stator 14 and the rotor 15 are not brought into press contact with each other, the ultrasonic motor 9 can not rotate. Hence, even if the control singal is wrongly supplied to the ultrasonic motor 9, the ultrasonic motor does not rotate.

More still furthermore, when the ignition switch is turned off, the current is not supplied to the electromagnet 22 so that the ultrasonic motor 9 is not driven.

Although the invention has been described in its preferred form with a certain degree of particularity, it is to be understood that many variations and changes are possible in the invention without departing from the scope thereof.

What is claimed is:

1. A throttle valve control system of an engine comprising:

a throttle body forming a suction passage;

a throttle valve positioned in a throttle body and rotatably fixed to a rotary shaft; said rotary shaft is rotatably fixed to the throttle body at both ends thereof;

a return spring mounted on one end of the rotary shaft for urging the throttle valve in the direction to close;

an ultrasonic motor for driving the throttle valve, said ultrasonic motor composed of a stator mounted on one side of the throttle body and provided with an elastic member having a plurality of piezoelectric elements and a travelling wave generator surface respectively disposed on the elastic member, and a rotor positioned at the outside of the stator and fixed to an extension of the rotary shaft, said rotor being rotatable by receiving the travelling wave generated by the travelling wave generator surface;

a valve opening ratio detector for detecting an opening ratio of the throttle valve and providing a valve opening ratio signal;

a depression ratio detector for detecting a depression ratio of the acceleration pedal and providing a depression ratio signal;

a comparator for receiving the valve opening ratio signal and the depression acceleration signal and comparing both signals on the basis of acceleration/rotary angle characteristic and providing a control signal to compensate the difference between both the signals, said control signal is supplied to the ultrasonic motor for driving the ultrasonic motor.

2. A throttle valve control system of an engine according to claim 1, wherein an electromagnet fixed to the stator is energized to attract an magnet member fixed to the rotor so that the rotor is attracted by the stator and brought into press contact with each other while the electromagnet is deenergized so that the stator does not pressedly contact the rotor whereby the rotor can be freely rotated and the throttle valve is closed by an urging force of the return spring.

* * * * *